US007185831B2

(12) United States Patent
Goenka et al.

(10) Patent No.: US 7,185,831 B2
(45) **Date of Patent: *Mar. 6, 2007**

(54) LOW PRESSURE FUEL INJECTOR NOZZLE

(75) Inventors: Lakhi N. Goenka, Ann Arbor, MI (US); Jeffrey Paul Mara, Livonia, MI (US); David Lee Porter, Westland, MI (US); David Ling-Shun Hung, Novi, MI (US); John Stefanski, Pinckney, MI (US)

(73) Assignee: Ford Motor Company, Dearborn, MI (US)

( * ) Notice: Subject to any disclaimer, the term of this patent is extended or adjusted under 35 U.S.C. 154(b) by 143 days.

This patent is subject to a terminal disclaimer.

(21) Appl. No.: 10/982,617

(22) Filed: Nov. 5, 2004

(65) Prior Publication Data

US 2006/0096569 A1 May 11, 2006

(51) Int. Cl.
*F02M 61/00* (2006.01)

(52) U.S. Cl. ..... 239/533.12; 239/494; 239/497; 239/584; 239/596

(58) Field of Classification Search ..... 239/494, 239/497, 533.12, 584, 596
See application file for complete search history.

(56) References Cited

U.S. PATENT DOCUMENTS

| | | | |
|---|---|---|---|
| 3,326,191 | A | 6/1967 | Berlyn |
| 4,018,387 | A | 4/1977 | Erb et al. |
| 4,106,702 | A | 8/1978 | Gardner et al. |
| 4,139,158 | A | 2/1979 | Uehida |
| 4,254,915 | A | 3/1981 | Muller |
| 4,275,845 | A | 6/1981 | Muller |
| 4,346,848 | A | 8/1982 | Malcolm |
| 4,540,126 | A | 9/1985 | Yoneda et al. |
| 4,666,088 | A | 5/1987 | Krauss et al. |
| 4,801,095 | A | 1/1989 | Banzhaf et al. |
| 4,907,748 | A | 3/1990 | Gardner et al. |
| 5,163,621 | A | 11/1992 | Kato et al. |
| 5,201,806 | A | 4/1993 | Wood |
| 5,244,154 | A | 9/1993 | Buchholz et al. |
| 5,344,081 | A | 9/1994 | Wakeman |
| 5,383,597 | A | 1/1995 | Sooriakumar et al. |
| 5,402,943 | A | 4/1995 | King et al. |
| 5,449,114 | A | 9/1995 | Wells et al. |
| 5,497,947 | A | 3/1996 | Potz et al. |
| 5,533,482 | A | 7/1996 | Naitoh |
| 5,636,796 | A | 6/1997 | Oguma |
| 5,662,277 | A | 9/1997 | Taubitz et al. |
| 5,685,485 | A | 11/1997 | Mock et al. |
| 5,685,491 | A | 11/1997 | Marks et al. |
| 5,716,001 | A | 2/1998 | Wakeman et al. |
| 5,716,009 | A | 2/1998 | Ogihara et al. |

(Continued)

FOREIGN PATENT DOCUMENTS

| | | |
|---|---|---|
| EP | 0 551 633 A1 | 7/1993 |

(Continued)

*Primary Examiner*—Steven J. Ganey
(74) *Attorney, Agent, or Firm*—Gregory P. Brown; MacMillan, Sobanski, & Todd, LLC

(57) ABSTRACT

A nozzle for a low pressure fuel injector that improves the control and size of the spray angle, as well as enhances the atomization of the fuel delivered to a cylinder of an engine.

9 Claims, 2 Drawing Sheets

U.S. PATENT DOCUMENTS 5,762,272 A 6/1998 Tani et al.
5,899,390 A * 5/1999 Arndt et al. ..... 239/596
5,911,366 A 6/1999 Maier et al.
5,915,352 A 6/1999 Okamoto et al.
5,924,634 A 7/1999 Arndt et al.
5,934,571 A 8/1999 Schmidt et al.
6,029,913 A 2/2000 Stroia et al.
6,045,063 A 4/2000 Koike et al.
6,050,507 A 4/2000 Holzgrefe et al.
6,092,743 A 7/2000 Shibata et al.
6,102,299 A 8/2000 Pace et al.
6,168,094 B1 1/2001 Schatz et al.
6,168,095 B1 1/2001 Seitter et al.
6,170,763 B1 * 1/2001 Fuchs et al. ..... 239/533.12
6,176,441 B1 1/2001 Munezane et al.
6,257,496 B1 7/2001 Wyant
6,273,349 B1 8/2001 Fischbach et al.
6,296,199 B1 10/2001 Noller et al.
6,308,901 B1 10/2001 Nitkiewicz et al.
6,330,981 B1 12/2001 Nally, Jr. et al.
6,394,367 B2 5/2002 Munezane et al.
6,405,945 B1 6/2002 Dobrin
6,439,482 B2 8/2002 Hosoyama et al.
6,439,484 B2 8/2002 Harata et al.
6,494,388 B1 12/2002 Mueller et al.
6,499,674 B2 12/2002 Ren et al.
6,502,769 B2 1/2003 Imoehl
6,513,724 B1 2/2003 Joseph et al.
6,520,145 B2 2/2003 Hunkert
6,533,197 B1 3/2003 Takeuchi et al.
6,578,778 B2 6/2003 Koizumi et al.
6,581,574 B1 6/2003 Moran et al.
6,616,072 B2 9/2003 Harata et al.
6,626,381 B2 9/2003 Parrish
6,644,565 B2 11/2003 Hockenberger
6,666,388 B2 12/2003 Ricco
6,669,103 B2 12/2003 Tsai
6,669,116 B2 12/2003 Iwase
6,685,112 B1 2/2004 Hornby et al.
6,695,229 B1 2/2004 Heinbuch et al.
6,705,274 B2 3/2004 Kubo
6,708,904 B2 3/2004 Itatsu
6,708,905 B2 3/2004 Borissov et al.
6,708,907 B2 3/2004 Fochtman et al.
6,712,037 B2 3/2004 Xu
6,719,223 B2 4/2004 Yukinawa et al.
6,722,340 B1 4/2004 Sukegawa et al.
6,739,525 B2 5/2004 Dantes et al.
6,742,727 B1 6/2004 Peterson, Jr.
6,758,420 B2 7/2004 Arioka et al.
6,764,033 B2 7/2004 Dantes et al.
6,766,969 B2 7/2004 Haltiner, Jr. et al.
6,848,636 B2 * 2/2005 Munezane et al. ..... 239/533.12
2001/0017325 A1 8/2001 Harata et al.
2002/0008166 A1 1/2002 Fukaya et al.
2002/0092929 A1 7/2002 Arimoto
2002/0144671 A1 10/2002 Shiraishi et al.
2002/0170987 A1 11/2002 Aoki et al.
2003/0127540 A1 7/2003 Xu
2003/0127547 A1 7/2003 Nowak
2003/0141385 A1 7/2003 Xu
2003/0141387 A1 7/2003 Xu
2003/0173430 A1 9/2003 Spencer
2003/0234005 A1 12/2003 Sumisha et al.
2004/0050976 A1 3/2004 Kitamura
2004/0060538 A1 4/2004 Togashi et al.
2004/0104285 A1 6/2004 Okamoto et al.
2004/0129806 A1 7/2004 Dantes et al.

FOREIGN PATENT DOCUMENTS

EP WO 93/20349 10/1993
EP 0 611 886 B1 12/1998
GB 2 232 203 A 5/1990
JP 2-19654 1/1990
JP 5-280442 1/1993
JP 6-221163 9/1994
JP 2001-046919 2/2001
WO WO 93/04277 3/1993
WO WO 95/04881 2/1995

* cited by examiner

LOW PRESSURE FUEL INJECTOR NOZZLE

FIELD OF THE INVENTION

The present invention relates generally to fuel injectors for automotive engines, and more particularly relates to fuel injector nozzles capable of atomizing fuel at relatively low pressures.

BACKGROUND OF THE INVENTION

Stringent emission standards for internal combustion engines suggest the use of advanced fuel metering techniques that provide extremely small fuel droplets. The fine atomization of the fuel not only improves emission quality of the exhaust, but also improves the cold weather start capabilities, fuel consumption and performance. Typically, optimization of the droplet sizes dependent upon the pressure of the fuel, and requires high pressure delivery at roughly 7 to 10 MPa. However, a higher fuel delivery pressure causes greater dissipation of the fuel within the cylinder, and propagates the fuel further outward away from the injector nozzle. This propagation makes it more likely that the fuel spray will condense on the walls of the cylinder and the top surface of the piston, which decreases the efficiency of the combustion and increases emissions.

To address these problems, a fuel injection system has been proposed which utilizes low pressure fuel, define herein as generally less than 4 MPa, while at the same time providing sufficient atomization of the fuel. One exemplary system is found in U.S. Pat. No. 6,712,037, commonly owned by the Assignee of the present invention, the disclosure of which is hereby incorporated by reference in its entirety. Generally, such low pressure fuel injectors employ sharp edges at the nozzle orifice for atomization and acceleration of the fuel. However, the relatively low pressure of the fuel and the sharp edges result in the spray being difficult to direct and reduces the range of the spray. More particularly, the spray angle or cone angle produced by the nozzle is somewhat more narrow. At the same time, additional improvement to the atomization of the low pressure fuel would only serve to increase the efficiency and operation of the engine and fuel injector.

Accordingly, there exists a need to provide a fuel injector having a nozzle design capable of sufficiently injecting low pressure fuel while increasing the control and size of the spray angle, as well as enhancing the atomization of the fuel.

BRIEF SUMMARY OF THE INVENTION

One embodiment of the present invention provides a nozzle for a low pressure fuel injector which increases the spray angle, improves control over the direction of the spray, as well as enhances the atomization of the fuel delivered to a cylinder of an engine. The nozzle generally comprises a nozzle body and a metering plate. The nozzle body defines a valve outlet and a longitudinal axis. The metering plate is connected to the nozzle body and is in fluid communication with the valve outlet. The metering plate defines a nozzle cavity receiving fuel from the valve outlet. The metering plate defines a plurality of exit cavities receiving fuel from the nozzle cavity. Each exit cavity is radially spaced from the longitudinal axis and meets the nozzle cavity at a first exit orifice. Each exit cavity includes an upstream directing portion and a downstream portion. The intersection of the upstream directing portion and the downstream portion defines a second exit orifice. The second exit orifice has a diameter less than the smallest diameter of the upstream directing portion.

According to more detailed aspects, the upstream directing portion has a diameter which does not increase along its length in the downstream direction. Thus, the upstream directing portion may be cylindrical, conical, or generally decrease in diameter in the downstream direction. Preferably the downstream portion does increase in diameter in the downstream direction and thus forms an expanding exit cone. The upstream directing portion defines a separation zone trapping a portion of the fuel flow therein. The upstream directing portion directs fluid flow inwardly past the separation zone and towards an exit axis of the exit cavity prior to passing through the second exit orifice.

According to still further detailed aspects, each exit cavity defines an exit axis. Each exit axis may be tilted in the radial direction relative to the longitudinal axis to increase the spray angle of the nozzle. At the same time, the exit axis may be tilted in the tangential direction relative to the longitudinal axis to produce a swirl component to the fuel exiting the nozzle, thereby enhancing atomization of the fuel.

BRIEF DESCRIPTION OF THE DRAWINGS

The accompanying drawings incorporated in and forming a part of the specification illustrate several aspects of the present invention, and together with the description serve to explain the principles of the invention. In the drawings.

DETAILED DESCRIPTION OF THE INVENTION

Figure 1:
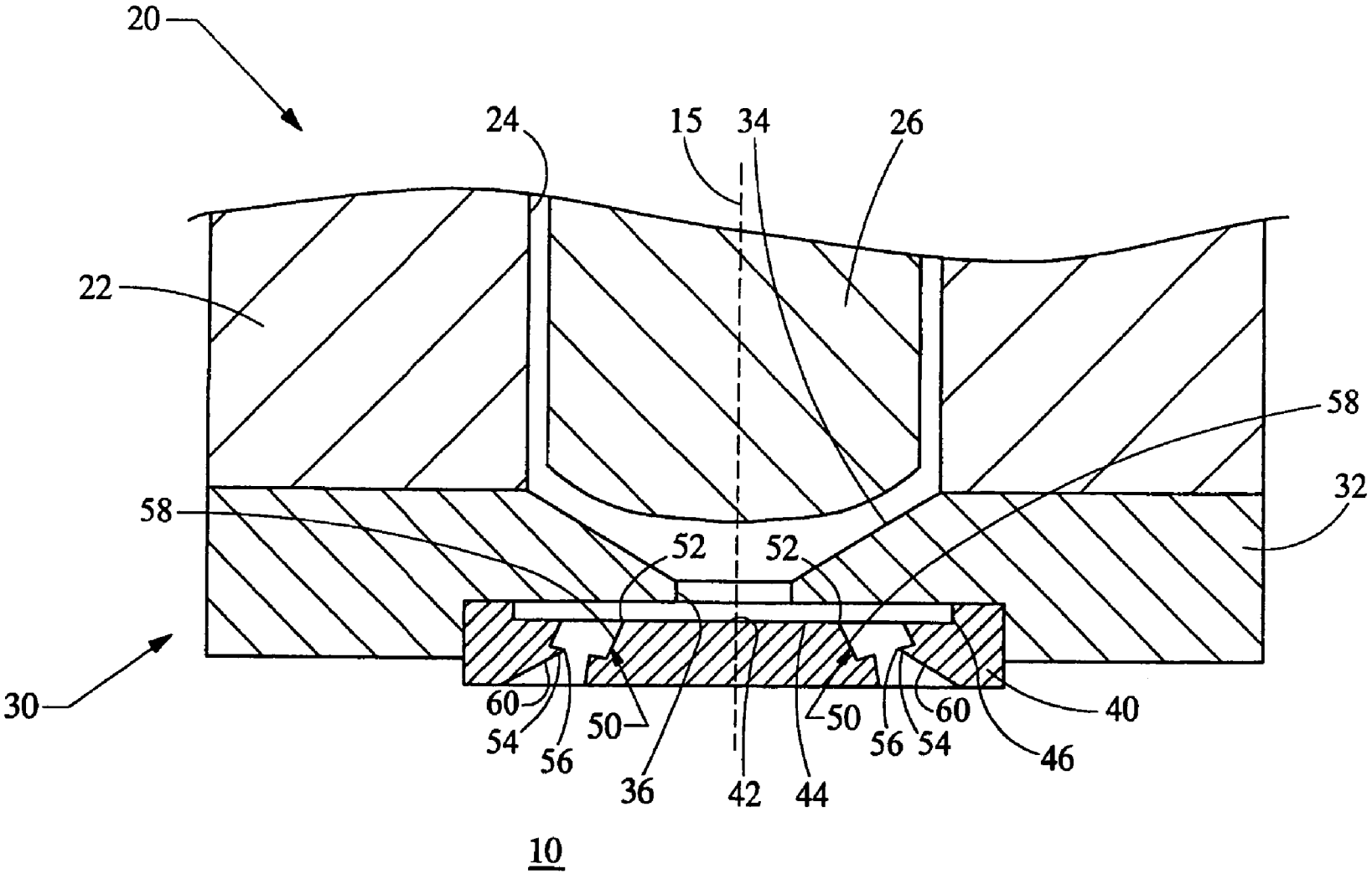
FIG. 1 is a cross-sectional view, partially cut-away, of a nozzle for a low pressure fuel injector constructed in accordance with the teachings of the present invention.

Turning now to the figures, FIG. 1 depicts a cross-sectional of a nozzle 20 constructed in accordance with the teachings of the present invention. The nozzle 20 is formed at a lower end of a low pressure fuel injector which is used to deliver fuel to a cylinder 10 of an engine, such as an internal combustion engine of an automobile. An injector body 22 defines an internal passageway 24 having a needle 26 positioned therein. The injector body 22 defines a longitudinal axis 15, and the internal passageway 24 extends generally parallel to the longitudinal axis 15. A lower end of the injector body 22 defines a nozzle body 32. It will be recognized by those skilled in the art that the injector body 22 and nozzle body 32 may be integrally formed, or alternatively the nozzle body 32 may be separately formed and attached to the distal end of the injector body 22 by welding or other well known techniques.

In either case, the nozzle body 32 defines a valve seat 34 leading to a valve outlet 36. The needle 26 is translated longitudinally in and out of engagement with the valve seat 34 preferably by an electromagnetic actuator or the like. In this manner, fuel flowing through the internal passageway 24 and around the needle 26 is either permitted or prevented from flowing to the valve outlet 36 by the engagement or disengagement of the needle 26 and valve seat 34.

The nozzle 20 further includes a metering plate 40 which is attached to the nozzle body 32. It will be recognized by those skilled in the art that the metering plate 40 may be integrally formed with the nozzle body 32, or alternatively may be separately formed and attached to the nozzle body 32 by welding or other well known techniques. In either case, the metering plate 40 defines a nozzle cavity 42 receiving fuel from the valve outlet 36. The nozzle cavity 42 is generally defined by a bottom wall 44 and a side wall 46 which are formed into the metering plate 40. The metering plate 40 further defines a plurality of exit cavities 50 receiving fuel from the nozzle cavity 42. Each exit cavity 50 is radially spaced from the longitudinal axis 15 and meets the nozzle cavity 42 at an exit orifice 52.

Figure 2:
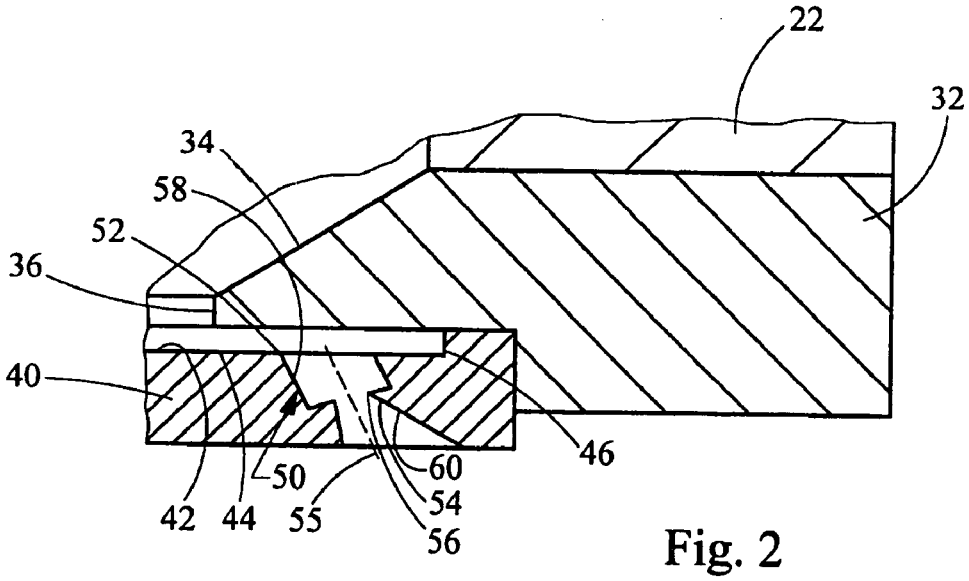
FIG. 2 is an enlarged cross-sectional view, partially cut-away, of the nozzle depicted in FIG. 1.

The metering plate 40 has been uniquely designed to increase the spray angle, improve control over the direction of the spray, as well as to increase the atomization of the fuel flowing through the metering plate 40 and into the cylinder 10 of the engine. With reference to FIGS. 1, 2 and 4, the exit cavity 50 of the metering plate includes an upstream portion 58 and a downstream portion 60. The upstream portion preferably has a diameter which does not increase along its length in the downstream direction. Preferably, and as shown in the figure, the upstream directing portion 58 is cylindrical in shape. The downstream portion 60 however may increase in diameter and is shown as being conical in shape or flared. The intersection of the upstream directing portion 58 and the downstream portion 60 defines a second exit orifice 56. The second exit orifice 56 is preferably sharp edged such that fuel flowing past both sharp edge orifices 52, 56 have increased levels of turbulence which enhances the atomization of the fuel. The second exit orifice 56 has a diameter that is less than the smallest diameter of the upstream directing portion 58. Stated another way, a shoulder 54 is formed at the intersection of the upstream directing portion 58 and the downstream portion 60 of the exit cavity 50.

Accordingly, it will be recognized by those skilled in the art that the exit cavity 50 defines a separation zone 62 in the upstream directing portion 58 which traps a portion of the fuel flow against the shoulder 54. In this manner, the turbulence of the fuel flowing through the exit cavity 50 is increased, to thereby enhance atomization of the fuel. At the same time, the constant or narrowing diameter of the upstream directing portion 58 prevents expansion of the fuel and thereby largely controls the direction of the fuel being spray into the cylinder 10 of the engine. The length to diameter ratio of the upstream directing portion 58 is controlled to prevent expansion of the fuel.

Accordingly, it will be recognized by those skilled in the art that the upstream directing portion 58 may be utilized to improve the spray angle as well as improve control over the direction of the spray of fuel entering the engine cylinder 10. For example, the exit cavity 50 defines an exit axis 55. As best seen in FIG. 2, the exit axis 55 is tilted radially relative to the longitudinal axis 15, thereby increasing the spray angle of the nozzle 20. As best seen in FIG. 4, the exit axis 55 is also tilted in the tangential direction relative to the longitudinal axis 15. In this manner, the exit cavities 50 produce swirl component to the fuel exiting the nozzle 20 and being delivered to the engine cylinder 10. Thus, by tilting the exit cavities 50 radially and/or tangentially, the spray angle may be increased while at the same time obtaining better control over the direction of the spray and enhancing the atomization of the fuel through the swirling component of the discharge spray.

Figure 3:
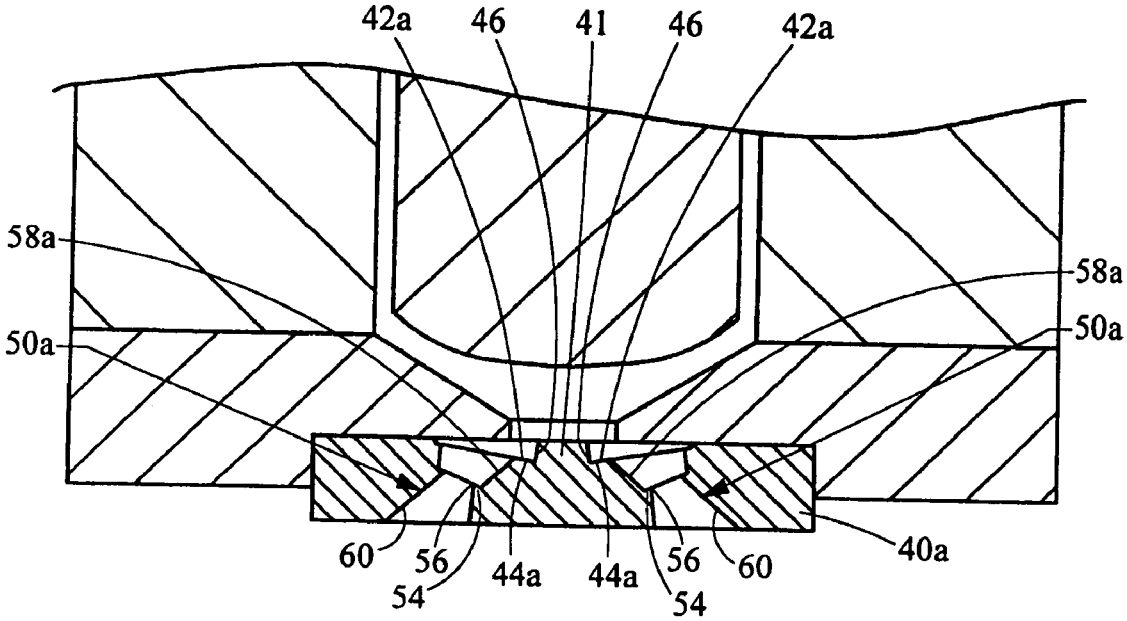
FIG. 3 is a cross-sectional view, partially cut-away, of another embodiment of the nozzle for a low pressure fuel injector constructed in accordance with the teachings of the present invention.

Turning now to FIG. 3, an alternate embodiment of the nozzle and metering plate 40*a* has been depicted. First, it is noted that the nozzle cavity 42*a* is annular in shape and includes an island 41 formed in the center thereof about the longitudinal axis 15. Further, the bottom wall 44*a* of the nozzle cavity 42*a* slopes upwardly as it extends radially outwardly away from the longitudinal axis 15. These structures reduce the volume of the nozzle cavity 42*a* to thereby increase the pressure and acceleration of the fuel through the metering plate 40.

In the embodiment of FIG. 3, it will also be noted that the upstream directing cavity 58*a* has been formed in a shape which decreases in diameter in the downstream direction. That is, the upstream directing portion 58*a* is conical. Thus the upstream directing portion 58*a* prevents the fuel from expanding, and actually decreases the available volume to further accelerate the fuel and enhance atomization. At the same time, the second exit orifice 56 is still provided at the intersection of the downstream cavity 60 and the upstream directing cavity 58*a*. Like the previous embodiments, the exit cavities 50*a* are oriented along an exit axis 55*a* which may be tilted radially and/or tangentially relative to the longitudinal axis 15 in order to increase the spray angle, as well as introduce a swirl component to the spray to thereby further increase the atomization of the fuel. Thus, the structure and orientation of each exit cavity, in concert with the plurality of exit cavities, enhances the spray angle and control over the direction of the spray.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

The invention claimed is:

1. A nozzle for a low pressure fuel injector, the fuel injector delivering fuel to a cylinder of an engine, the nozzle comprising:

a nozzle body defining a valve outlet and a longitudinal axis;

a metering plate connected to the nozzle body and in fluid communication with the valve outlet;

the metering plate defining a nozzle cavity receiving fuel from the valve outlet;

the metering plate defining a plurality of exit cavities receiving fuel from the nozzle cavity, each exit cavity radially spaced from the longitudinal axis and meeting the nozzle cavity at a first exit orifice; and each exit cavity including an upstream directing portion and a downstream portion, the intersection of the upstream directing portion and the downstream portion defining a second exit orifice having a diameter less than a smallest diameter of the upstream directing portion.

2. The nozzle of claim 1, wherein the upstream directing portion is cylindrical.

3. The nozzle of claim 1, wherein the upstream directing portion is conical.

4. The nozzle of claim 1, wherein the upstream directing portion decreases in diameter in the downstream direction.

5. The nozzle of claim 1, wherein the downstream portion increases in diameter in the downstream direction.

6. The nozzle of claim 1, wherein the upstream directing portion defines a separation zone trapping a portion of the fuel flow.

7. The nozzle of claim 1, wherein the upstream directing portion directs the fluid flow inwardly towards an exit axis of the exit cavity prior to passing through the second exit orifice.

8. The nozzle of claim 1, wherein each exit cavity defines an exit axis, each exit axis being tilted in the radial direction relative to the longitudinal axis to increase the spray angle of the nozzle.

9. The nozzle of claim 1, wherein each exit cavity defines an exit axis, the exit axis being tilted in the tangential direction relative to the longitudinal axis to produce a swirl component to the fuel exiting the nozzle.

* * * * *